US006095242A

United States Patent [19]

Lequang et al.

[11] Patent Number: 6,095,242

[45] Date of Patent: Aug. 1, 2000

[54] CASING HANGER

[75] Inventors: Huy Lequang; Amrik S. Nijjar, both of Houston, Tex.

[73] Assignee: FMC Corporation, Chicago, Ill.

[21] Appl. No.: 09/384,670

[22] Filed: Aug. 27, 1999

Related U.S. Application Data

[60] Provisional application No. 60/100,249, Aug. 28, 1998.

[51] Int. Cl.[7] ..... E21B 19/00

[52] U.S. Cl. ..... 166/88.2; 166/88.3; 166/368

[58] Field of Search ..... 166/368, 88.2, 166/88.3, 75.14, 208, 209; 175/423

[56] References Cited

U.S. PATENT DOCUMENTS

| | | | |
|---|---|---|---|
| 1,728,432 | 9/1929 | Mildren | 166/88.3 |
| 2,493,556 | 1/1950 | Stone | 175/423 |
| 2,689,139 | 9/1954 | Jones et al. | 166/75.14 |
| 2,690,344 | 9/1954 | Allen | 166/75.14 |
| 3,437,356 | 4/1969 | Todd et al. | 175/423 |
| 5,031,695 | 7/1991 | Cain et al. | 166/208 |
| 5,467,825 | 11/1995 | Vallet | 166/208 |

*Primary Examiner*—William Neuder

*Attorney, Agent, or Firm*—Gary L. Bush; Mayor, Day, Caldwell & Keeton, L.L.P.

[57] ABSTRACT

A casing hanger assembly is disclosed which includes a bottom member which centralizes a casing string within a casing head and a top member of a conventional slip-type casing hanger design. The bottom member functions to rigidly centralize the casing string inside the casing head while absorbing any side bending load induced by movements of the casing string. The top member, set on top of the bottom centralizer member, supports and transfers the weight of the casing string to the casing head.

7 Claims, 9 Drawing Sheets

CASING HANGER

REFERENCE TO PRIOR APPLICATION

This application claims priority from Provisional Application 60/100,249 filed Aug. 28, 1998.

BACKGROUND OF THE INVENTION

1. Field of the Invention

This invention relates generally to oil and gas wells, particularly subsea wells. In particular, the invention relates to a tieback casing string provided in offshore petroleum production installations for providing a protective barrier and a fluid conduit between a subsea wellhead and a surface wellhead located on an offshore drilling or completion platform. Still more particularly, this invention relates to a slip type well casing hanger, for suspending a tieback casing string from a subsea wellhead to a surface wellhead located on an offshore drilling or completion platform.

2. Description of the Prior Art

Prior arrangements to tieback a subsea wellhead to the surface wellhead of a subsea well have been complicated, requiring a great amount of equipment and high installation cost. Furthermore, conventional slip type hangers potentially cause fatigue failure of the casing string suspended with a conventional slip type hanger.

The sharp, hardened teeth of conventional casing hanger slips produce a series of circumferential grooves around the outside diameter of the casing. The bottom of these grooves has very sharp points which act as stress risers. On a floating offshore platform, the conventional casing string is continuously moving due to ocean waves and currents. The sharp teeth of the casing hanger slips become a pivot or fulcrum point for side bending loads due to horizontal movement. Such side bending load is supported by the sharp teeth of the slip, and these teeth continuously produce deeper and deeper circumferential grooves, thus creating a potential for fatigue failure.

Various wellhead supply companies have supplied a type of adjustable casing hanger to circumvent the potential of fatigue failure with conventional slip type hangers. These companies include ABB Vetco Gray, Cameron, FMC and Drilquip. The prior adjustable casing hangers are expensive requiring complex and expensive running tools.

OBJECTS OF THE INVENTION

A primary object of the invention is to simplify and reduce equipment and installation cost required to tieback a subsea wellhead to the surface wellhead.

Another object of the invention is to solve the problems of potential fatigue failure of a casing string suspended with a conventional slip type hanger.

An ultimate object of the invention is to provide a simple, economical, adjustable tieback suspension and tensioning system that provides metal to metal sealing and does not require special tooling for installation and adjustment during installation.

Another object of this invention is to provide an arrangement by which prior fatigue problems are obviated by moving the pivot point away from the sharp teeth of a conventional slip type casing hanger.

Another object of this invention is to provide a well casing hanger which does not require any special adjustable mandrel hanger and running tools.

SUMMARY OF THE INVENTION

The objects identified above, as well as other features and advantages, are embodied in a new casing hanger, called here a Centra-Slip™ casing hanger. It is used on an offshore platform to space out the tieback casing string between the subsea wellhead and the surface wellhead on the platform. The new Centra-Slip casing hanger is used to rigidly centralize the casing string and then support the weight of the casing string between the casing string and the surface wellhead on the platform.

The Centra-Slip casing hanger has two major components. The bottom half has a fatigue resistance centralizer. It is set on the load shoulder inside the surface wellhead. Its function is to rigidly centralize the casing string inside the surface wellhead, thus absorbing any side bending load induced by continuous movement of the casing string due to ocean waves and currents. It includes a centralizer bowl and centralizer segments.

The centralizer segments have a tapered surface on the outside diameter to match the tapered surface on the inside diameter of the centralizer bowl. The centralizer segments have a smooth surface on the inside diameter to prevent scoring and marking on the outside diameter of the casing string. The centralizer segments are engaged by being pushed down by energizing screws in the centralizer bowl. As the energizing screws are tightened, they force the centralizer segments downward between the centralizer bowl and the casing string. The downward motion of the centralizer segments moves the centralizer bowl outward against the inside surface of the surface wellhead. This wedging action of the tapered segments removes any radial looseness and clearance between the casing string and surface wellhead. Other types of centralizers such as a centralizer ring may alternatively be used. The ring is of C-shape to allow for radial movement to provide rigid centralization. Other arrangements to energize centralizer segments such as springs on top of the centralizer segments may also be provided.

The top half of the Centra-Slip hanger is a slip type casing hanger of conventional design. It is set on top of the centralizer bowl of the bottom half of the hanger. The slip type casing hanger is used to support/transfer the weight between the casing string and the surface wellhead. It includes a slip bowl, slips and lock nut. The outside diameter taper of the slips matches the inside diameter taper in the slip bowl to provide wedging action. The inside surface of slips has sharp, hardened teeth pointing in an upward direction to bite and thus grip the casing string.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which:

FIG. 1B is a cross-section of the centralizer of FIG. 1A taken along lines 1B—1B;

DESCRIPTION OF THE PREFERRED EMBODIMENT OF THE INVENTION

The invention of the Centra-Slip casing hanger is made up of three major components. Each component performs a different function.

Figure 1A:
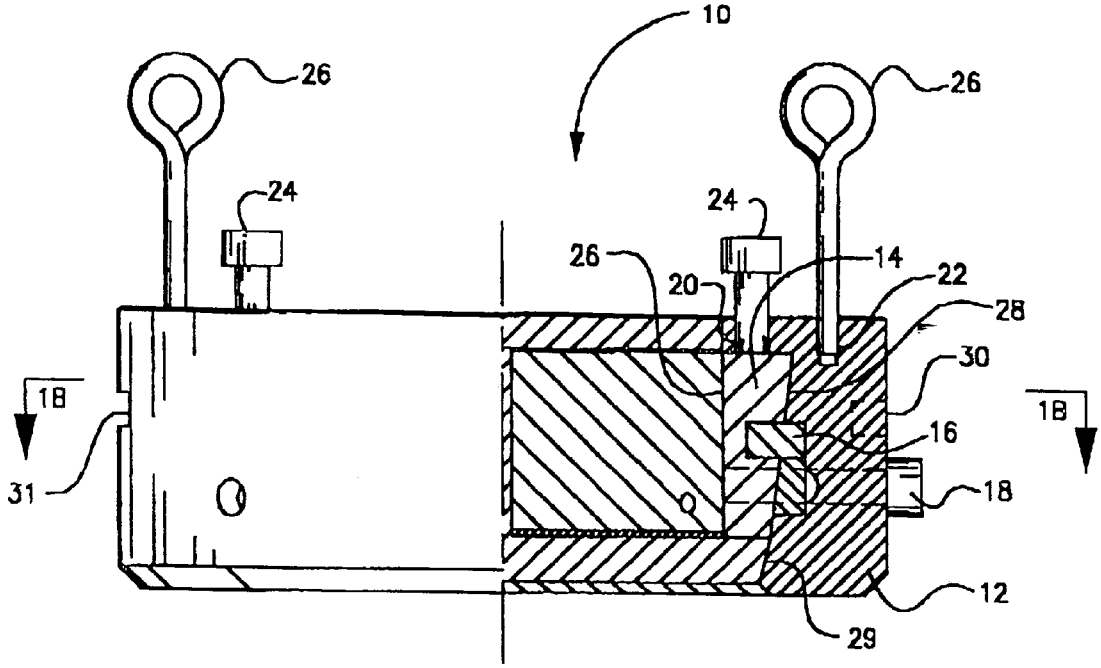
FIGS. 1A and 1B illustrate a fatigue resistant centralizer of the bottom half of the Centra-Slip hanger of the invention where
Figure 1B:
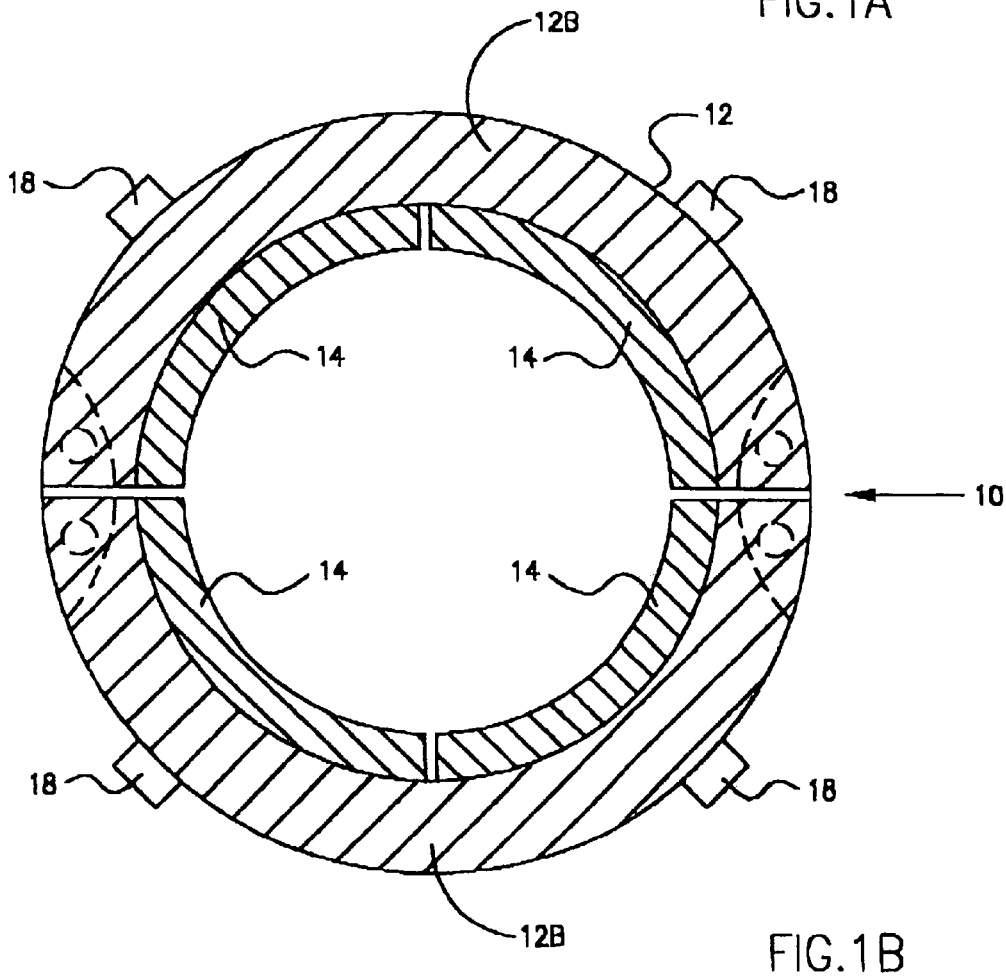

FIGS. 1A and 1B illustrate the bottom half of the Centra-Slip hanger of the invention which is a fatigue resistance centralizer 10. It consists of a centralizer bowl 12 and centralizer segments 14. The centralizer segments 14 are oriented into the centralizer bowl 12 with an aligning ring 16. The centralizer segments 14 are held in the upper most position with retainer screws 18. The centralizer segments 14 have a maximum inside diameter in the upper-most position, thus making wrapping of the centralizer assembly around the casing much easier. The inner surface 26 of centralizer segments 14 is smooth and substantially vertical while the outer surface 28 is inclined at an angle to match the tapered bore 29 of centralizer bowl 12. The top of the centralizer bowl has threaded holes 20, 22. The inner holes 20 are for energizing screws 24 which are used to engage the centralizer segments 14. The outer holes 22 are for lifting bolts 26 for lifting and handling purposes. The centralizer bowl 12 is split into multiple segments 12A, 12B to facilitate its installation around the casing. The centralizer bowl segments 12A, 12B are held together with hinge 30 and a latch 31.

Figure 2:
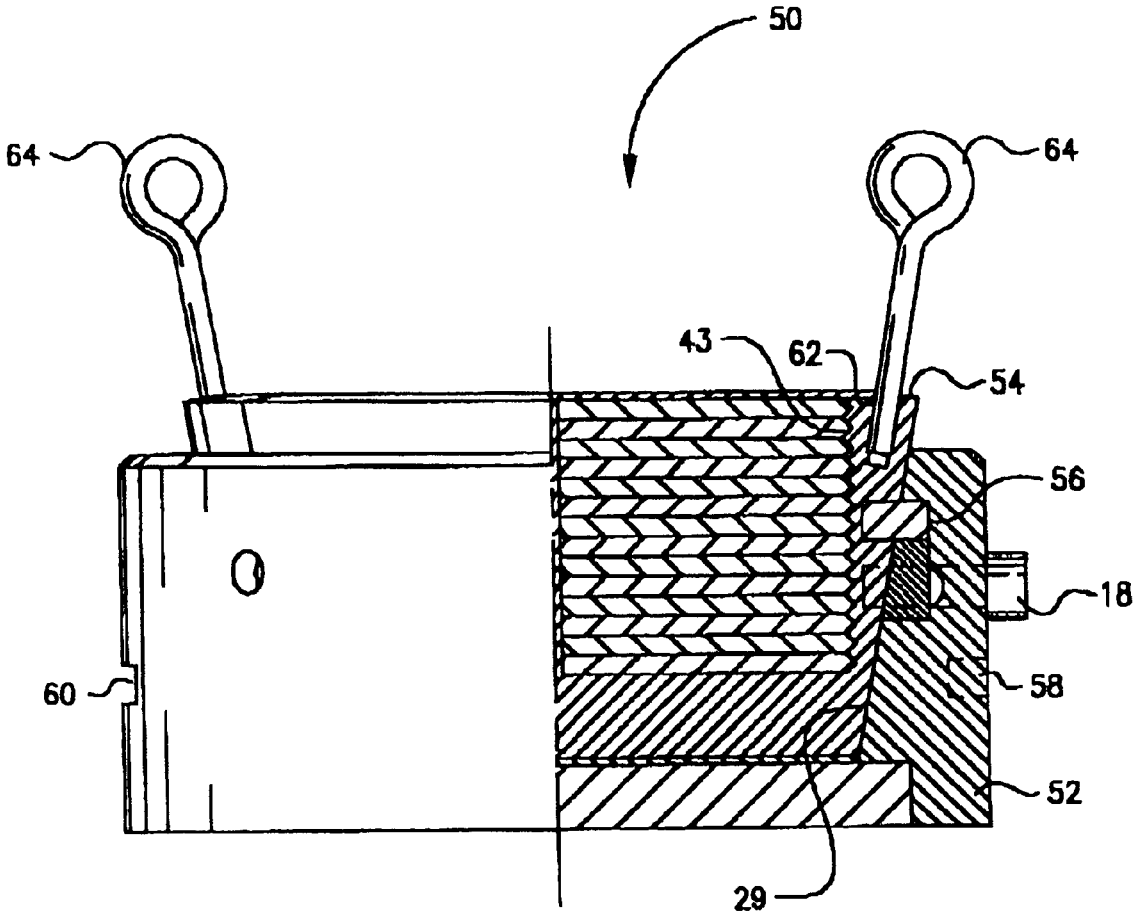
FIG. 2 illustrates the top half of the Centra-Slip hanger of the invention.

The top half 50 of the Centra-Slip casing hanger of the invention is a typical slip type casing hanger and is illustrated in FIG. 2. This part of the casing hanger consists of two major components. The outside component 52 is called the slip bowl. The inside component is a slip assembly consisting of multiple slip segments or "slips" 54. The slips have an outer tapered surface 29 which matches the inner taper of slip bowl 52. The slips have an inner surface with sharp teeth 43. The slip assembly is retained inside the slip bowl with an aligning ring 56. The slip bowl 52 is split into multiple pieces to facilitate its installation around the casing. The slip bowl pieces are held together with hinges 58 and a latch 60. The top ends of the slip segments have threaded holes 62 for lifting eye bolts 64. The bottom 10 and top 50 halves of the Centra-Slip casing hanger are secured into a casing head bowl 90 with a threaded lock nut 99 (See FIG. 6).

Figure 3:
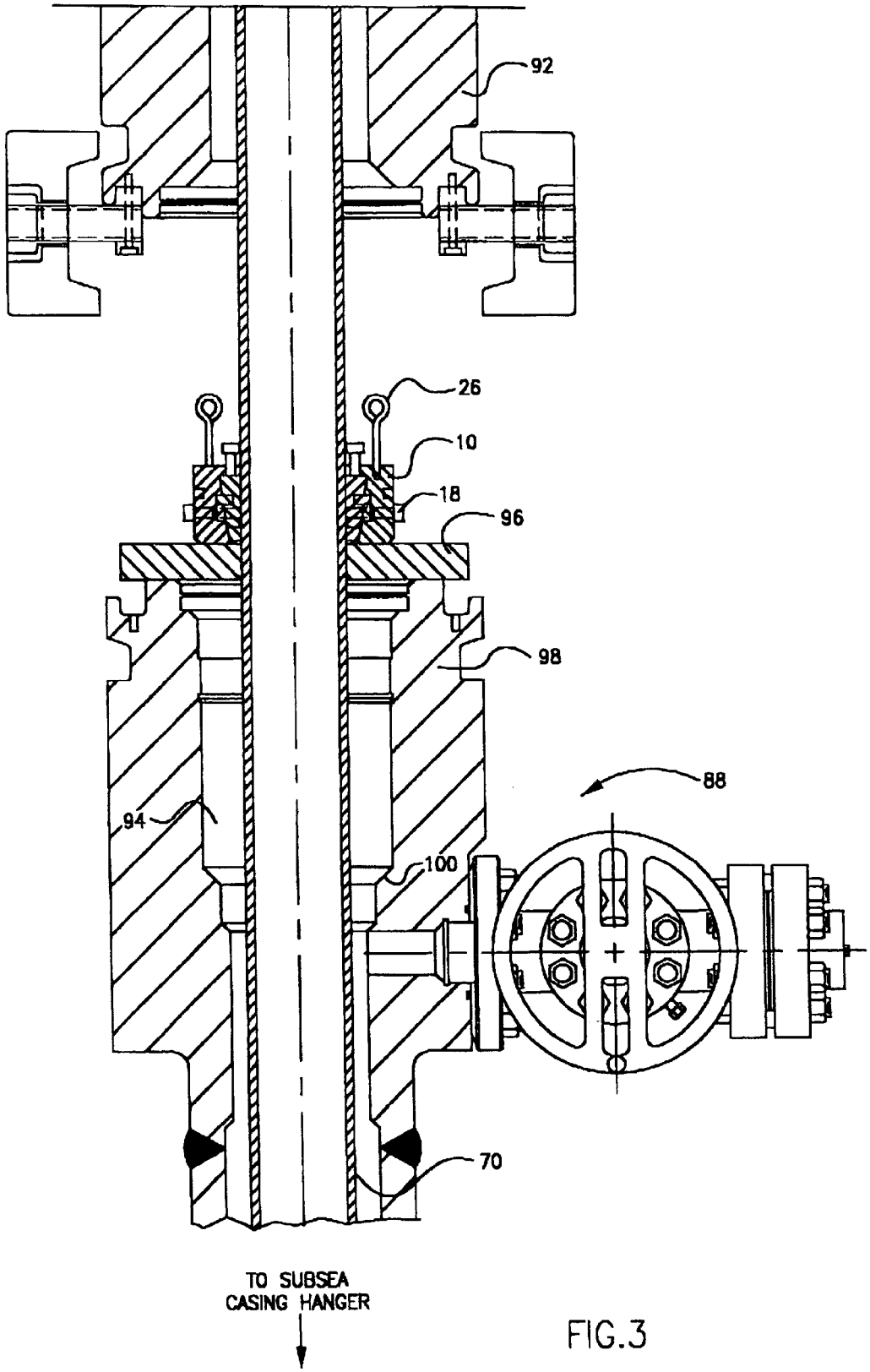
FIGS. 3 and 4 illustrate installation of the tieback casing string at the surface wellhead in the bottom half centralizer assembly of the Centra-Slip hanger of the invention.
Figure 4:
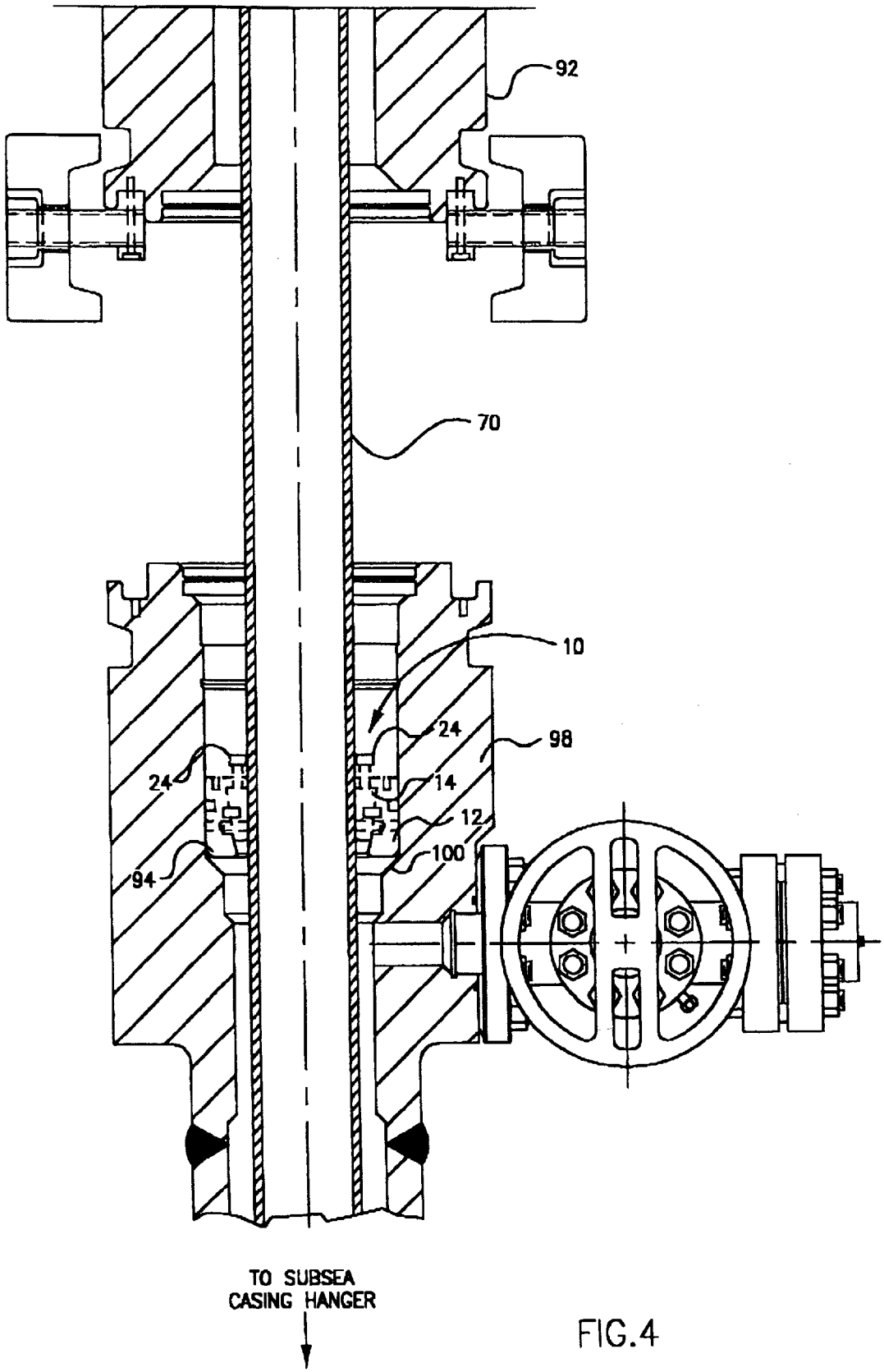

FIG. 3 illustrates the first stage in the installation of the Centra-Slip casing hanger of the invention. A tieback casing string 70 is lowered through the surface wellhead 88 until the bottom of the tieback string 70 engages and connects to the subsea casing hanger, which is suspended within the subsea well (not shown). The blowout preventer 92 (BOP) is then disconnected from the surface wellhead 88 and raised to provide access to the surface wellhead bowl 94. Two boards 96 are placed on the top surface of casing head or spool 98 against the casing string 70. The bottom part of the Centra-Slip casing hanger, the centralizer assembly 10, is unlatched, spread about by means of hinge 30, and then wrapped around the casing string 70 and latched again. The centralizer assembly 10 is positioned on boards 96. The retainer screws 18 for the centralizer segments 14 and the lifting bolts 26 are removed. The boards 96 are then removed, thereby allowing the centralizer assembly 10 to drop into the casing head bowl 94. FIG. 4 shows the centralizer assembly 10 after it has dropped into wellhead bowl 94. The centralizing bowl 12 is checked to insure that it is seated on the load shoulder 100 in the casing head 98 by tapping down on the centralizer bowl 12. Next, the energizing screws 24 are tightened to engage the centralizer segments against the exterior surface of the casing string 70 and to force the outer surface of bowl 12 against the inner surface of bowl 94.

Figure 5:
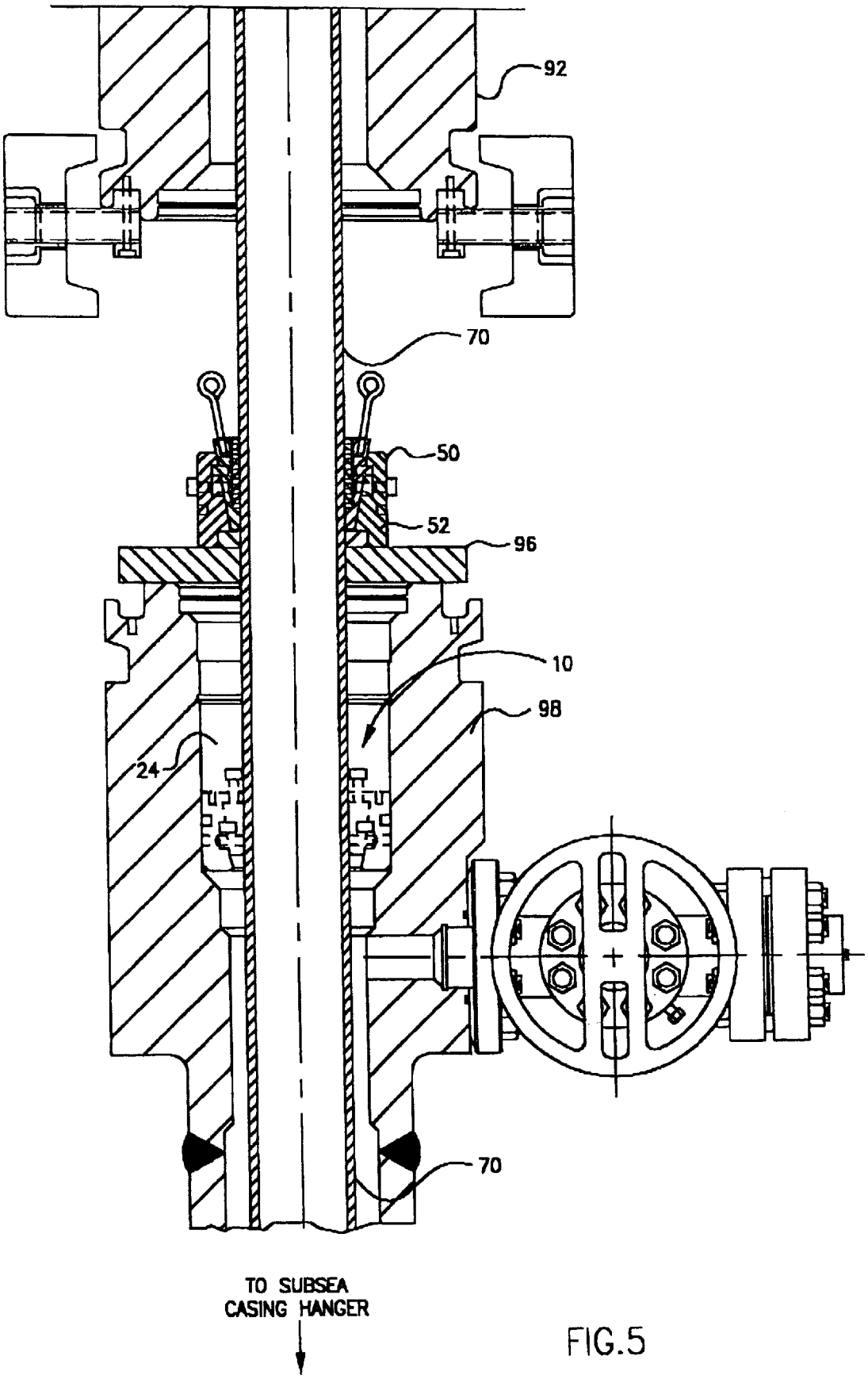
FIGS. 5 and 6 illustrate installation of the tieback casing string in the top half of the Centra-Slip hanger of the invention.
Figure 6:
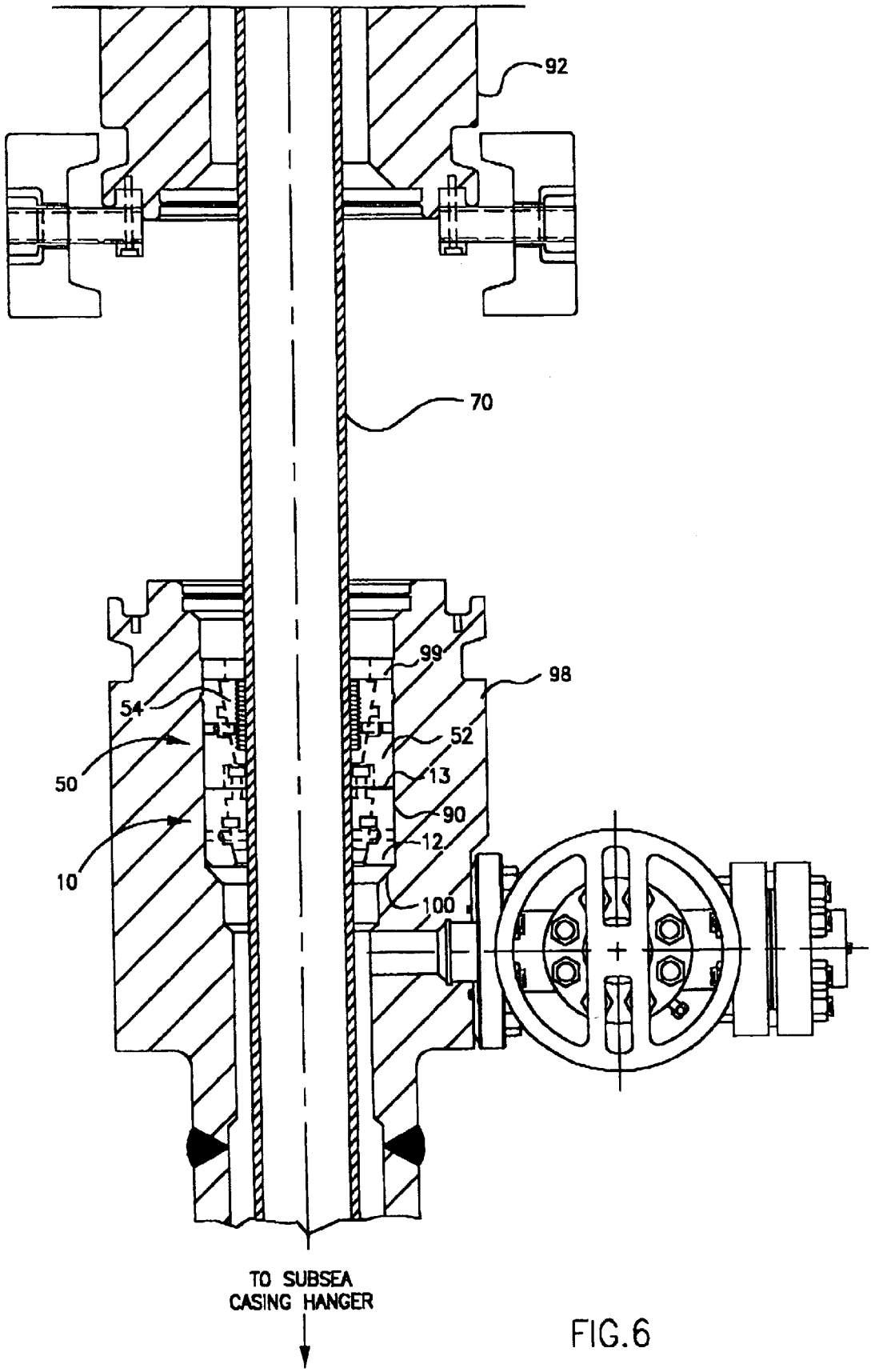

Next, as illustrated in FIG. 5, the top half of the Centra-Slip casing hanger, a slip-type casing hanger 50, is installed in the casing head 98 by following the same procedure used for centralizer assembly 10. As shown in FIG. 6, the slip bowl 52 is seated on the top 13 of the centralizer bowl 12. As illustrated in FIG. 6, two halves of a lock nut 99 are positioned around the casing string 70 and then the halves are secured together with screws. The lock nut 99 is then threaded into the casing head 98 and tightened against the top of the slip bowl 52. In this position, the lock nut 99 prevents the vertical movement of the slip bowl 52 and the centralizer bowl 12 during the tensioning of the casing string.

The casing string 70 is tensioned to the required load. The slip segments 54 are engaged by hammering down the top of the segments. The slips 54 are checked to insure that they have engaged evenly around the casing 70. The casing 70 is marked at the top of the casing head 98. This gives a visual indication when the slips engage. The tension is slacked off to load the casing string weight slowly onto the slip type hanger 50. The sharp teeth of the slips bite into the outside diameter of casing to provide a solid grip and thus support the weight of the casing string. The casing string weight is transferred to the slips 54, slip bowl 52, centralizer bowl 12 and then to the load shoulder 100 inside the casing head 98.

Figure 7:
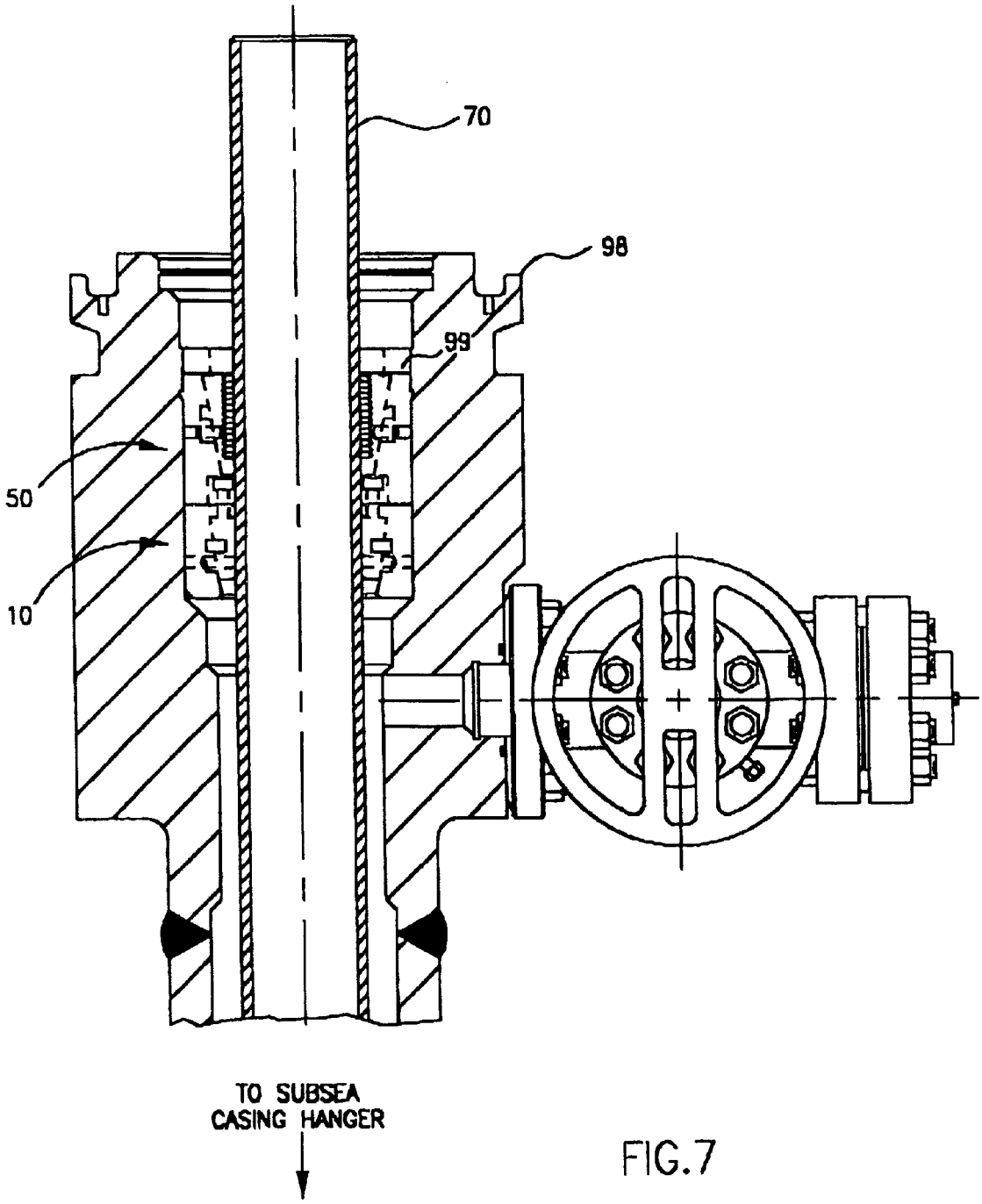
FIG. 7 illustrates cutting off of the casing string at a required height above the top of the casing head.

Next, as shown in FIG. 7, the casing string 70 is cut at a required height above the top of the casing head 98.

Figure 8:
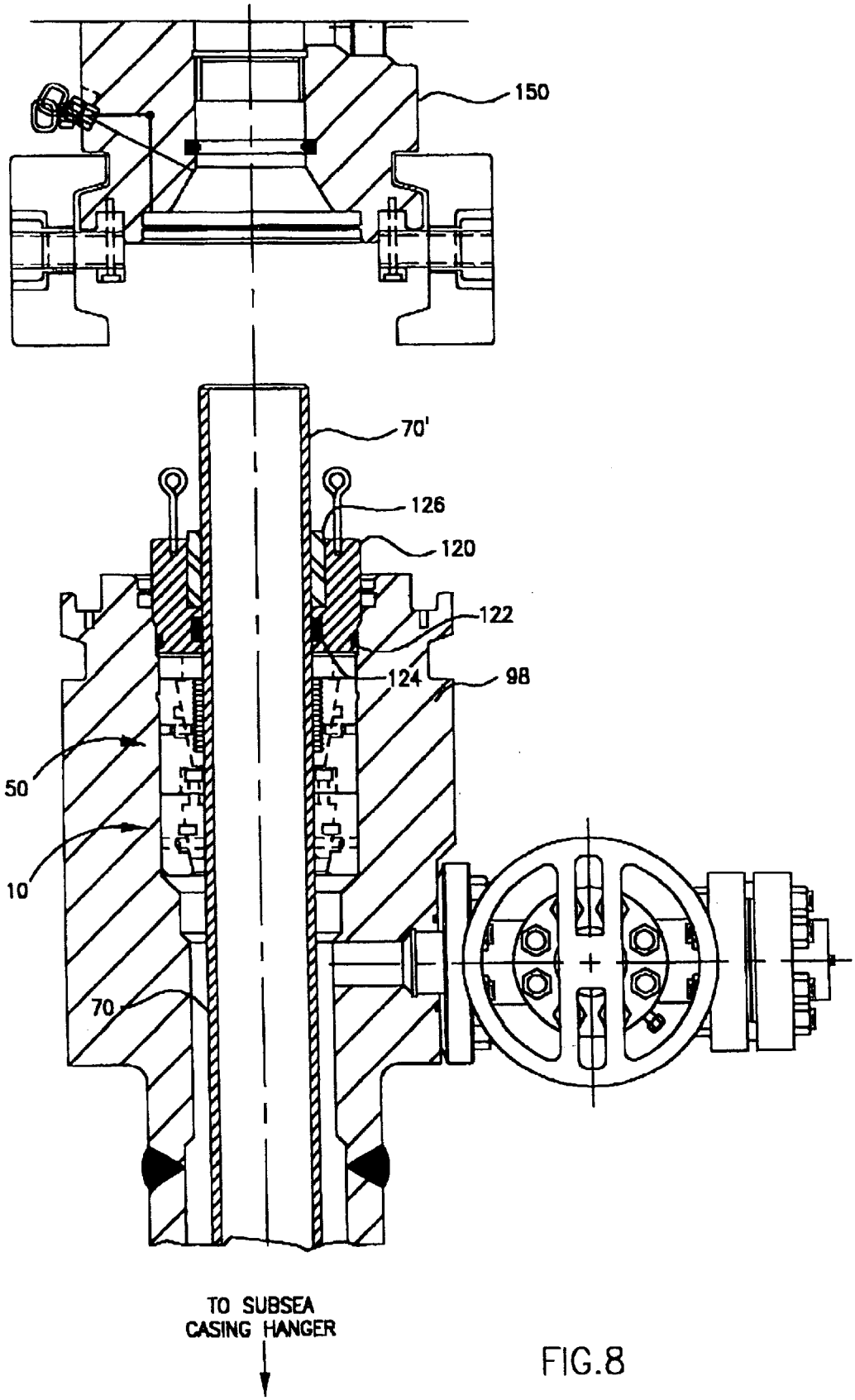
FIG. 8 illustrates providing a seal bushing over the casing stub.
Figure 9:
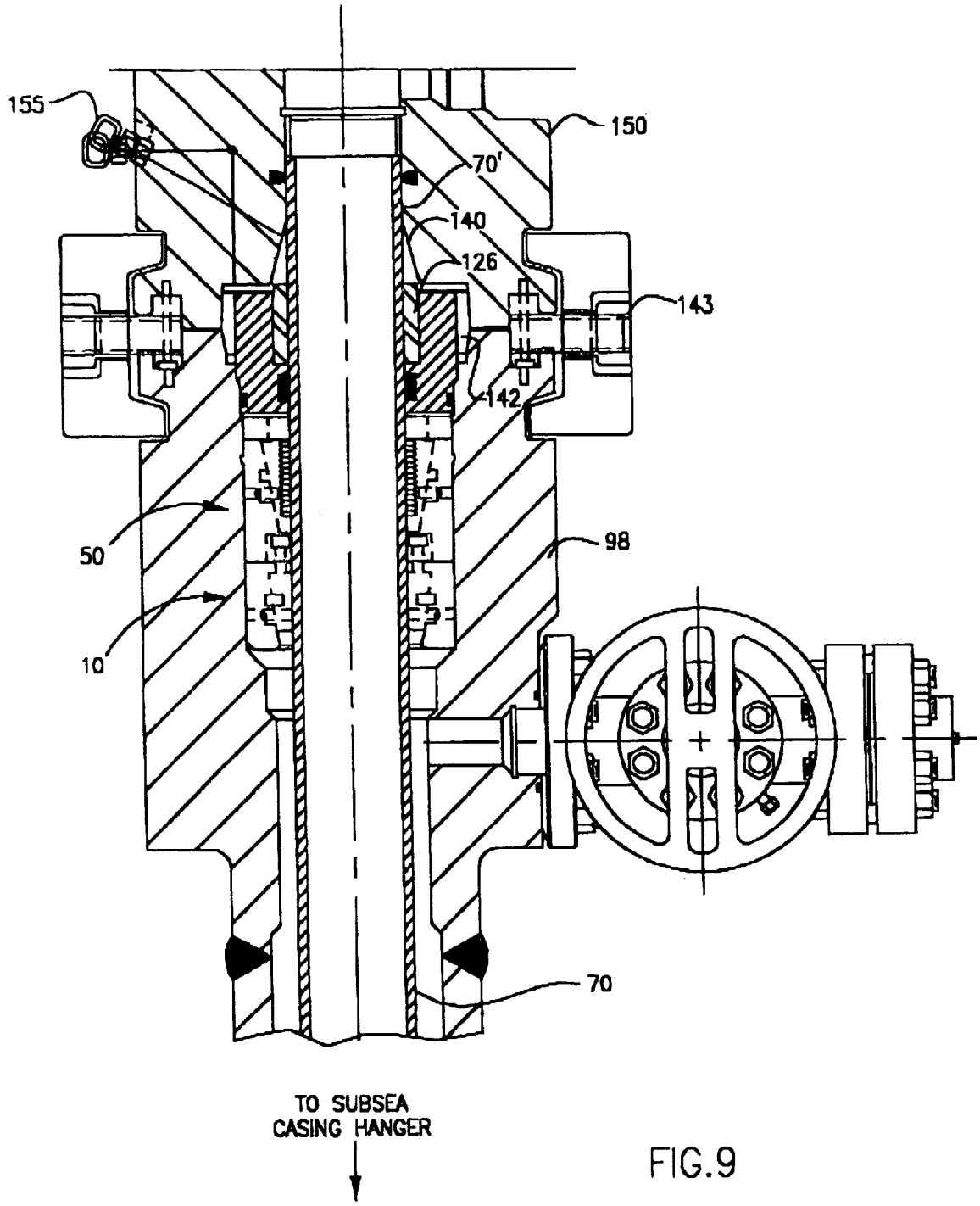
FIG. 9 illustrates the installation of a tubing head installed on top of the tieback casing string.

As illustrated in FIG. 8, a seal bushing 120 is installed over the casing stub 70'. The seal bushing 120 has OD 122 and ID 124 seals to seal the annulus below the face of the casing head 98. This seal bushing 120 also includes an adjustment nut 126 which provides adjustment for a rough casing metal seal (RCMS) 140 (see FIG. 9), which is set on top of the adjustment nut 126. As illustrated in FIGS. 8 and 9, the tubing head 150 is lowered over the casing stub 70' until it touches the RCMS 140. The standoff between the faces of casing head 98 and the tubing head 150 is measured. This standoff is adjusted to the required amount using the adjustable nut 126. Then a connection is made with speedloc clamp 143 pulling the tubing head 150 and the casing head 98 together with required force to energize the RCMS 140 against stub 70'. A SBMS-SL metal seal 142 is installed for the speedloc connection as illustrated. All seals are pressure tested through the test ports 155 in the tubing head.

What is claimed is:

1. A centralizer assembly for a casing string within a casing head comprising, a centralizer bowl (12) with curved tapered inner surfaces, said centralizer bowl being arranged and designed to be placed about said casing string and supported from a landing shoulder within said casing head while defining an annular space between said tapered surfaces and said casing string, centralizer segments (14) placed in said annular space and having smooth inner surfaces which are substantially coaxial with and matching the radial curvature of said casing string and having tapered outer surfaces (28) which match the taper and curvatures of said inner surfaces of said centralizer bowl, and energizing screws (24) extending through said centralizer bowl (12) and engaging said centralized segments (24) for forcing said centralizer segments into said annular space in a wedging relationship between said casing string and said tapered inner surfaces thereby removing radial looseness and clearance between said casing string and said casing head.

2. The centralizer assembly of claim 1, wherein, said centralizer bowl includes two halves which are hinged together to permit said bowl to be opened for wrapping about said casing string prior to insertion within said casing head.

3. The centralizer assembly of claim 2, wherein, said centralizer segments are removably secured to said centralizer bowl halves prior to said halves being wrapped about said casing string.

4. The centralizer assembly of claim 3, further comprising, lifting bolts removably secured to top surfaces of said centralizer bowl.

5. A casing hanger assembly for supporting a casing string from a casing head comprising, a bottom centralizer assembly means arranged and designed to be landed on an internal shoulder of said casing head, for rigidly centralizing the casing string within said casing head, a top slip-type casing hanger means, set on top of said bottom centralizer assembly means for supporting and transferring the weight of said casing string to said casing head and, a lock nut placed on top of said slip-type casing hanger means and arranged and designed to be removably secured to said casing head and for securing said centralizer assembly means and said slip-type casing hanger means within said casing head.

6. The casing hanger assembly of claim 5, further comprising, a seal bushing placed on top of said lock nut and between said casing string and said casing means, and means on said seal bushing for sealing an exterior surface of said casing string and an interior surface of said casing head.

7. A casing hanger assembly for supporting a casing string from a casing head comprising, a centralizer bowl with curved tapered inner surfaces, said bowl being arranged and designed to be placed about said casing string and supported from a landing shoulder within said casing head while defining an annular space between said tapered surfaces and said casing string, centralizer segments placed in said annular space and having smooth inner surfaces which are substantially coaxial with and matching the radial curvature of said casing string and having tapered outer surfaces which match the taper and curvatures of said inner surfaces of said centralizer bowl, energizing screws extending through said centralizer bowl and engaging said centralizer segments for forcing said centralizer segments into said annular space in a wedging relationship between said casing string and said tapered inner surfaces thereby removing radial looseness and clearance between said casing string and said casing head, a top slip-type casing hanger set on to of said centralizer bowl, said casing hanger having slips for securing said casing string to said casing hanger, and a lock nut removably secured to said casing head and positioned on top of said slip type casing hanger for securing said centralizer assembly and said casing hanger in said casing head.

* * * * *